US008590070B2

(12) United States Patent
Chen

(10) Patent No.: US 8,590,070 B2
(45) Date of Patent: Nov. 26, 2013

(54) WATER-SAVING TOILET BOWL WITHOUT WATER TANK

(76) Inventor: Fuhuan Chen, Cangnan County (CN)

( * ) Notice: Subject to any disclaimer, the term of this patent is extended or adjusted under 35 U.S.C. 154(b) by 0 days.

(21) Appl. No.: 13/641,454

(22) PCT Filed: Apr. 2, 2011

(86) PCT No.: PCT/CN2011/072412

§ 371 (c)(1),
(2), (4) Date: Oct. 15, 2012

(87) PCT Pub. No.: WO2011/134339

PCT Pub. Date: Nov. 3, 2011

(65) Prior Publication Data

US 2013/0031709 A1 Feb. 7, 2013

(30) Foreign Application Priority Data

Apr. 30, 2010 (CN) ..... 2010 2 0180288 U

(51) Int. Cl.
*E03D 11/00* (2006.01)

(52) U.S. Cl.
USPC ..... 4/431

(58) Field of Classification Search
USPC ..... 4/420–442
See application file for complete search history.

(56) References Cited

FOREIGN PATENT DOCUMENTS

| | | | |
|---|---|---|---|
| CN | 1322268 A | * | 11/2001 |
| CN | 1532351 A | * | 9/2004 |
| JP | 3253628 | * | 11/1991 |
| JP | 3253628 A | * | 11/1991 |
| JP | 9256448 A | * | 9/1997 |

* cited by examiner

*Primary Examiner* — Lori Baker

(57) ABSTRACT

A water-saving toilet bowl without a water tank, which comprises a flush pipe, a discharging pipe and a flush device. The flush device comprises a control cavity and a control valve that controls a drive motor to open or close the control cavity. A linkage rod links with a motor shaft of the drive motor. A through hole is provided in a partition. A control valve core is linked with the linkage rod via the through hole so that the control valve core is slid so as to open or close the through hole, and thereby the pressure change is controlled. The flush pipe of the toilet bowl is connected to two outlet passages of the flush device. An inlet passage is communicated with the outlet passages through a connection passage, and effluent water enters the flush pipe to flush the toilet bowl.

8 Claims, 10 Drawing Sheets

A-A

WATER-SAVING TOILET BOWL WITHOUT WATER TANK

BACKGROUND OF THE INVENTION

1. Field of the Invention

The present invention relates to a toilet bowl, and more particularly to a water-saving toilet bowl without a water tank.

2. Description of the Prior Art

A conventional toilet bowl comprises a toilet bowl body and a tank. The toilet bowl body has a cavity to receive excrement. The bottom of the cavity is connected with a curved discharge pipe. The discharge pipe is further connected to a sewage pipe. The tank is connected with a water pipe for water feeding. A flush pipe is connected with the cavity to flush the cavity so as to clean the excrement. The accommodation chamber of the tank is large in size. When in use, the water in the tank flows out fully. This consumes a lot of water.

SUMMARY OF THE INVENTION

The primary object of the present invention is to provide a water-saving toilet bowl without a water tank to overcome the shortcomings of the prior art.

In order to achieve the aforesaid object, the water-saving toilet bowl without a water tank of the present invention comprise a toilet bowl body and a flush pipe disposed in the toilet bowl body. The toilet bowl body comprises a cavity and a discharge pipe communicating with the bottom of the cavity. The toilet bowl further comprises a flush device in the toilet bowl body. The flush device comprises a casing, an end cap fixed to the casing, an inlet passage and an outlet passage. The inlet passage is disposed at the junction of the casing and the end cap. The inlet passage is connected with a water pipe. The outlet passage is connected with a flush pipe. The casing has a connection passage therein. The inlet passage and the outlet passage communicate with the connection passage. A separation member is provided between the casing and the end cap. A control cavity is defined between the end cap and the separation member. The separation member is adapted to open or close the connection passage and the inlet passage so as to control communication of the inlet passage and the outlet passage. The separation member has a throttle bore to communicate the inlet passage and the communication passage with the control cavity. The control cavity is connected to a control valve. The control valve is controlled by a power source to open or close the control cavity. The power source is a drive motor. The drive motor comprises a control switch located on the toilet bowl body. The control valve comprises an outer casing, a linkage rod inserted in the outer casing and a control valve core connected with the linkage rod. The linkage rod is connected with a motor shaft of the drive motor. The end cap has a hole to communicate with the control cavity. The outer casing of the control valve comprises a hollow protruding post corresponding to the hole of the end cap. The control valve core is disposed in the hollow protruding post. One end of the hollow protruding post, facing the linkage rod, is provided with a partition. The partition has a through hole. The control valve core is linked by the linkage rod through the through hole. The control valve core is slidably moved in the hollow protruding post to open or close the through hole.

The water-saving toilet bowl without a water tank uses the control switch to operate the drive motor. The linkage rod drives the control valve core to open the through hole so that the pressure change is controlled. The inlet passage and the connection passage are communicated for water flow. The water flows to the flush pipe to flush the toilet bowl. The purpose of the supplying water in real time without storing water is achieved so as to save water.

Preferably, the flush device is located in the cavity at one end of the toilet bowl body. The casing has at least two outlet passages and at least two connection passages. The two connection passages communicate with each other. At least two separation members are provided between the casing and the end cap. Another end of the casing, opposite to the end cap, has a pressure discharge cavity which communicates with the connection passages. A slide seal member is provided between the pressure discharge cavity and the connection passages for connection and disconnection of the pressure discharge cavity and the connection passages. A guide hole is formed between the pressure discharge cavity and the connection passages of the casing. The slide seal member is hanged in the guide hole to slide axially. The pressure discharge cavity communicates with the outer casing of the control valve through a communication pipe. The toilet bowl comprises two flush pipes to connect with the two outlet passages of the flush device. One of the two flush pipes is disposed on a side wall of the toilet bowl body corresponding to the opening of the cavity. The other of the two flush pipes is disposed in the toilet bowl body corresponding to the bottom of the cavity and has a spray pipe at one end thereof.

The water-saving toilet bowl without a water tank provides a plurality of passages to flush the toilet bowl. One passage from the inner wall of the cavity is used to flush the inner wall and another passage is used to flush the bottom of the cavity, such that the toilet bowl can be flushed clearly. The pressure discharge cavity is to discharge the pressure and water in the connection passage of the flush device.

Preferably, the flush pipe comprises a sleeve and a pipe body in the sleeve. One end of the sleeve of the flush pipe, corresponding to the bottom of the cavity, is connected with the spray pipe. The pipe body is flexible, and has one end for water feeding and another end inserted in the sleeve and connected with the spray pipe. The junction of the flush pipe and the spray pipe has a concaved inner wall to form a water passage having a curve cross-section. The pipe body is expandable when flushing.

The pipe body of the water-saving toilet bowl is concaved to compress the original cylindrical water passage to become an arc. When the water flows to this section of the flush pipe, the flow area is reduced. The inside of the pipe body can be filled with water easily to expel the air. The pipe wall is expandable for enough water flow. When in use, there is no remnant air to make a noise, providing a silent toilet flush. The sleeve is to enhance the strength of the flush pipe and is convenient for installation and use of the flush pipe. A certain space is formed between the sleeve and the pipe body for installation of the spray pipe at the end of the flush pipe. The water flow is received in the space before spraying out of the spray pipe, preventing the water pressure of the water outlet from being over. The area of the spray pipe is reduced so that the water flow is more powerful.

Preferably, the spray pipe has an oblique block on an inner wall thereof to guide water. The oblique block has an outer end surface flush with an outer end surface of the spray pipe. The oblique block has a high end to form a platform. The platform has a jet platform which is inclined vertically and curved transversely. A water outlet is defined between the jet platform and a pipe wall. The water outlet has a curve cross-section.

The oblique block of the water-saving toilet bowl is adapted to reduce the area of the water outlet and the difference of the water flow of the spray pipe to form a high pressure at the water outlet so that the water flow.

The water outlet forms high pressure, so the water flows out of the flush pipe at a high speed to flush the inner wall of the toilet bowl. Before jetting, the water passes the oblique block to cause a slope change of the flow area to store and release the pressure, so that the water flow is more powerful and the spray pipe won't disengage from the flush pipe because of over pressure.

Preferably, the control valve core comprises a first valve core body fixed to the end cap, a second valve core body having an end passing the through hole and linked by the linkage rod and slidable in the hollow protruding post, and a compression spring connected between the first valve core body and the second valve core body. One end of the first valve core body, close to the second valve core body, has a communication hole to communicate with the control cavity. The second valve core body comprises a seal protrusion corresponding in position to the communication hole to be contact with the communication hole. A seal membrane is provided between the second valve core body and the through hole. The seal membrane is adapted to open and close the through hole along with movement of the second valve core body.

The first valve core body is fixed and the second valve core body is driven by the linkage rod to open the through hole, such that the control cavity is able to release pressure. The seal member is biased by the compression spring to get contact with the through hole again so as to close the through hole. The motor shaft is reciprocated or one-way turned to open or close the control cavity.

Preferably, the first valve core body has a guide slot thereon and an annular positioning flange at one end thereof away from the second valve core body. The hollow protruding post presses the first valve core body against the end cap through the positioning flange. The second valve core body comprises a hook to mate with the guide slot. The hook is placed in the guide slot to position the second valve core body.

The first valve body can be positioned. The guide slot is adapted for installation of the first and second connection bodies and motion of the second connection body and communication of the through hole and the control cavity.

Preferably, the second valve core body has a seal flange corresponding in position to the through hole. The seal membrane is connected to the second valve core body through the seal flange.

The seal membrane can be firm secured to the second valve core body to seal the through hole.

Preferably, the linkage rod comprises press blocks thereon. The end of the second valve core body corresponds in shape to the press blocks of the linkage rod.

The press blocks are adapted to press the second valve core body to disengage the second valve core body and the seal membrane from the through hole. Preferably, the press blocks are disposed at different positions for distribution of the water pressure.

The toilet bowl of the present invention has the flush device instead of the traditional tank to reduce the size of the toilet bowl and to save the water and to provide a silent toilet flush.

DETAILED DESCRIPTION OF THE PREFERRED EMBODIMENTS

Embodiments of the present invention will now be described, by way of example only, with reference to the accompanying drawings.

Figure 1:
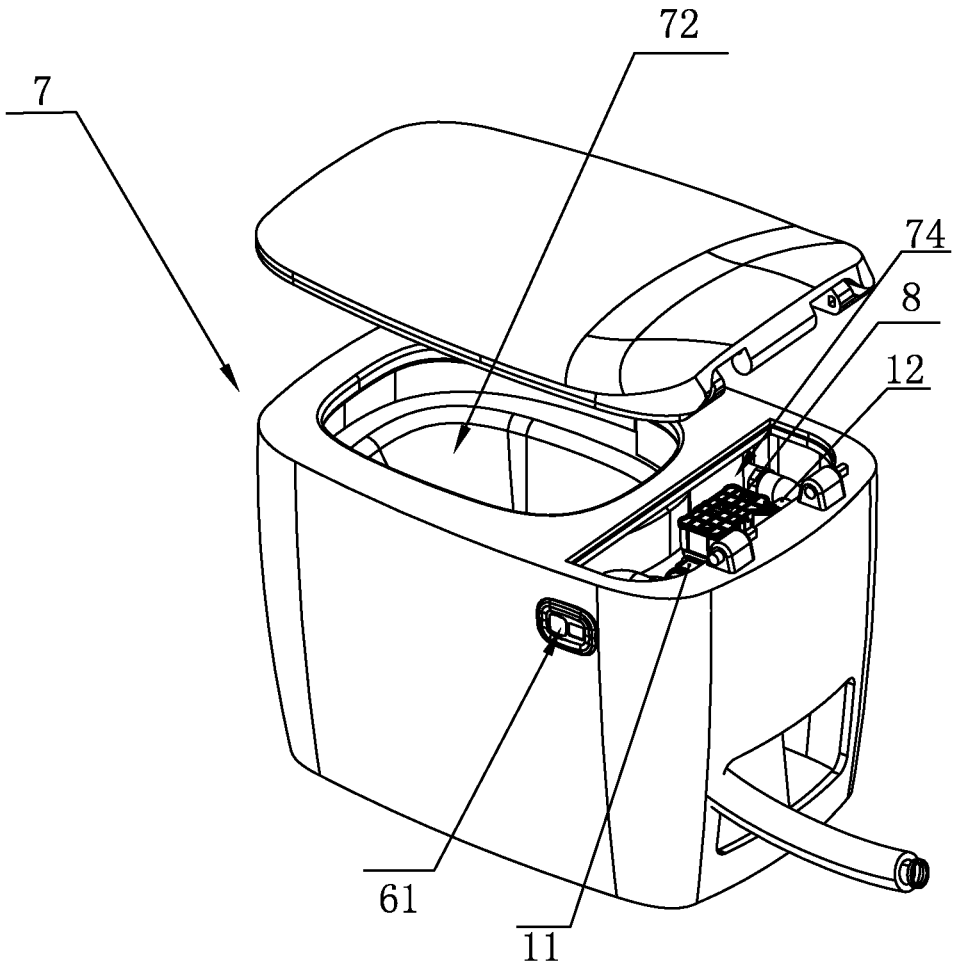
FIG. 1 is a perspective view according to a preferred embodiment of the present invention.
Figure 2:
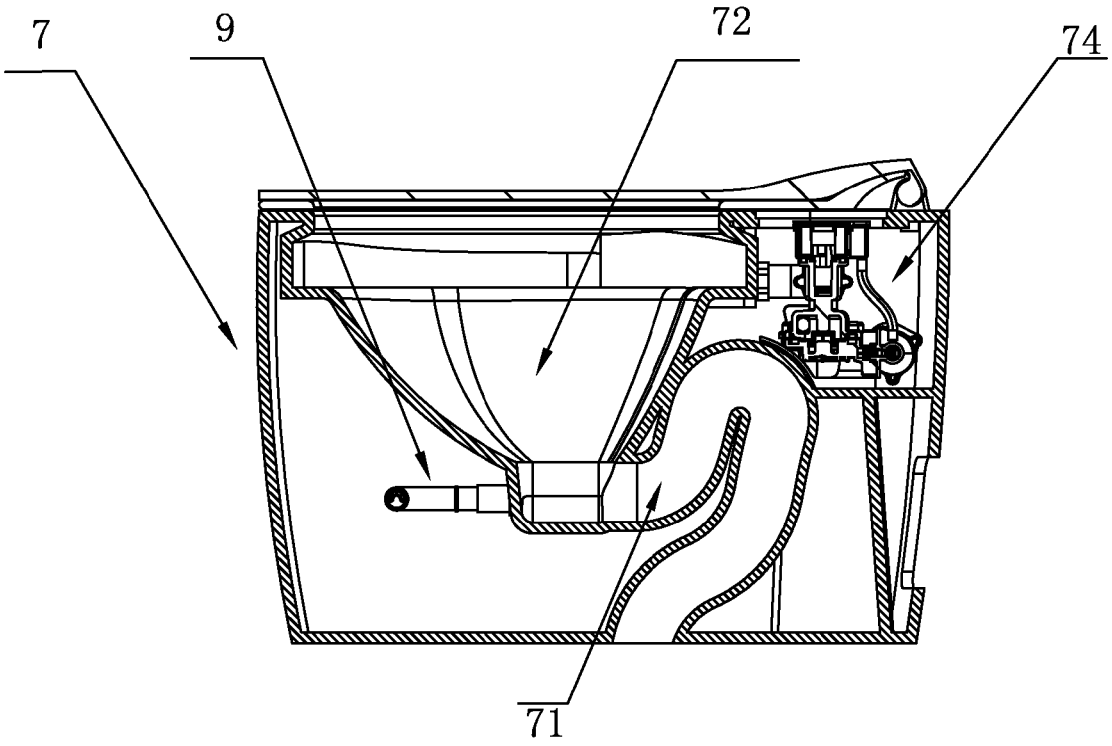
FIG. 2 is a sectional view according to the preferred embodiment of the present invention.
Figure 3:
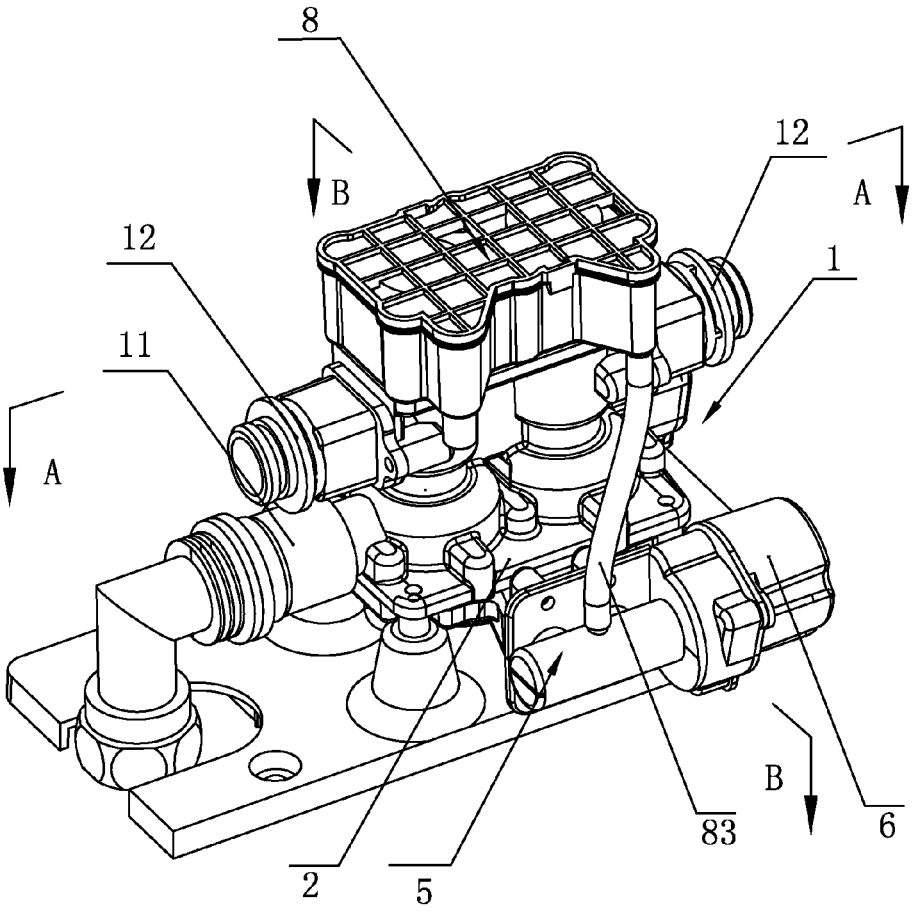
FIG. 3 is a perspective view showing the flush device according to the preferred embodiment of the present invention.
Figure 4:
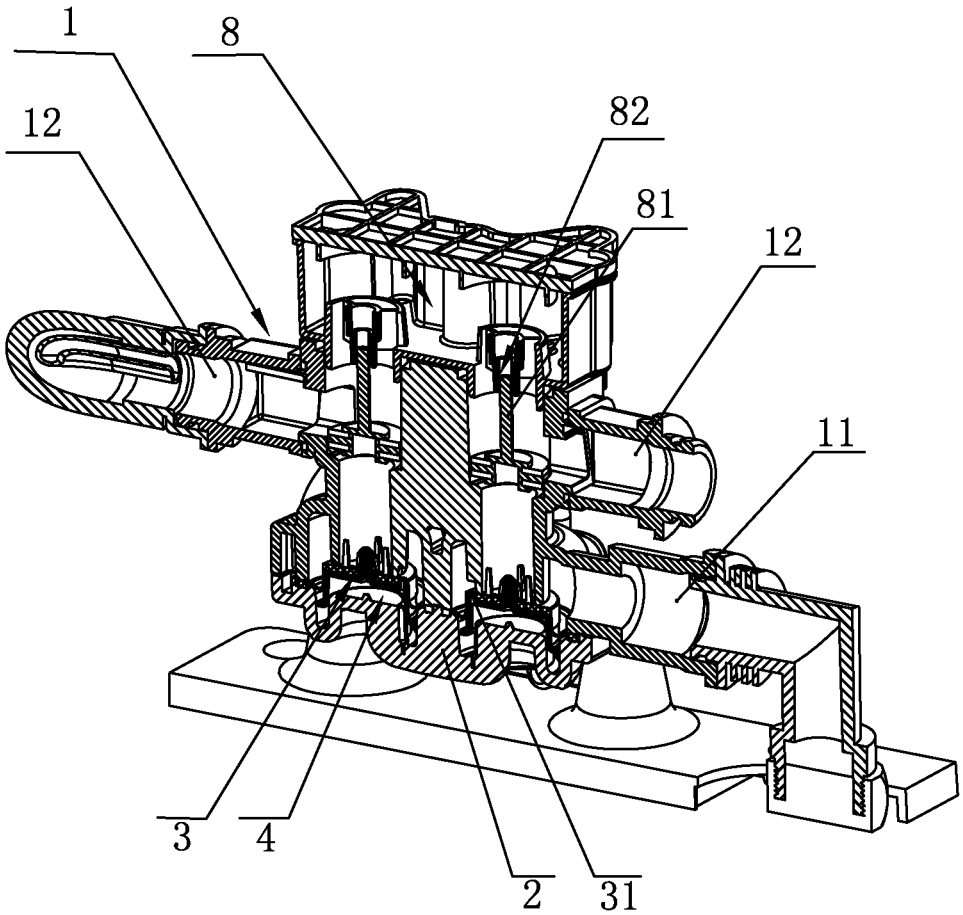
FIG. 4 is a sectional view taken along line A-A of FIG. 3.
Figure 5:
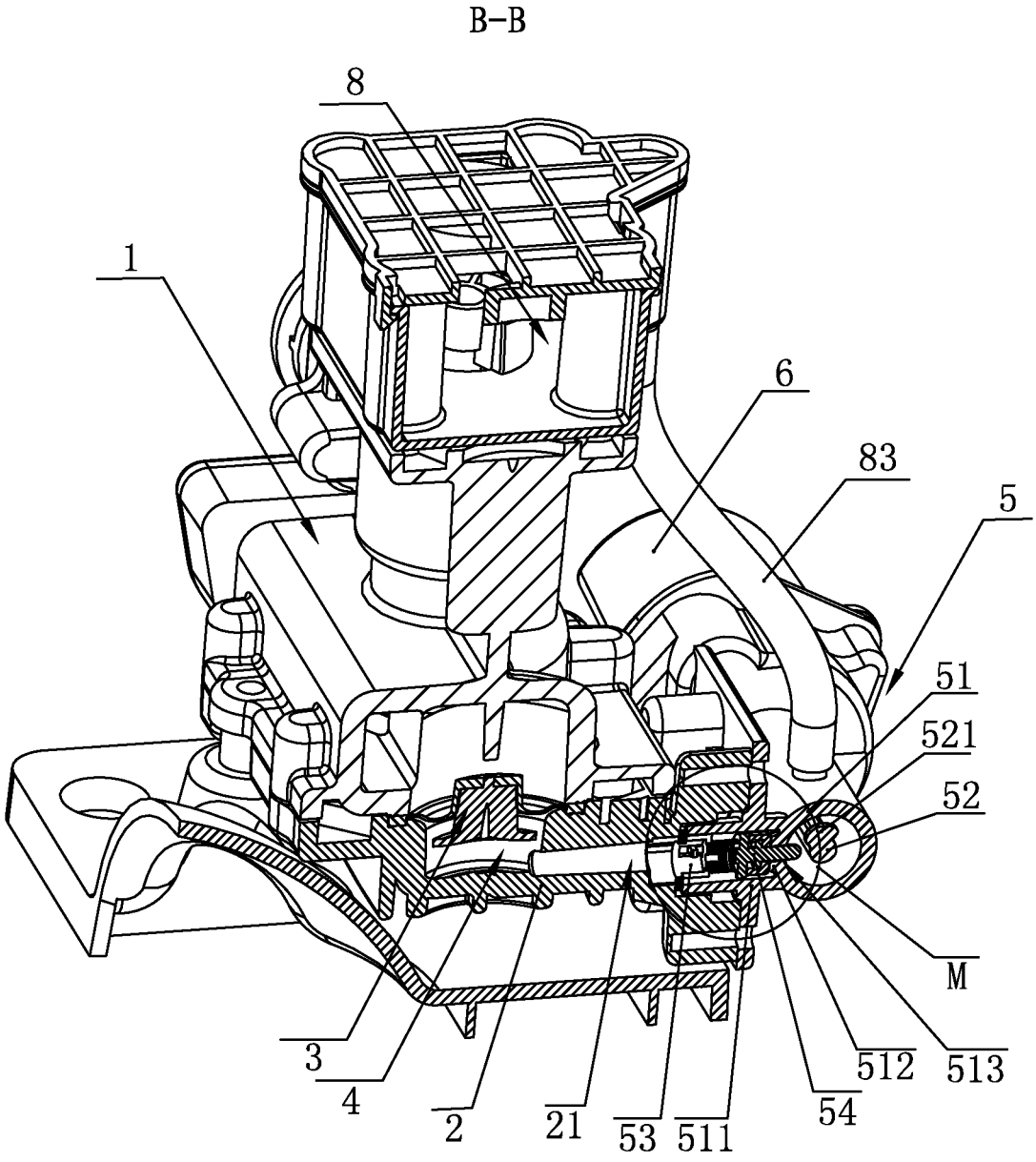
FIG. 5 is a sectional view taken along line B-B of FIG. 3.
Figure 6:
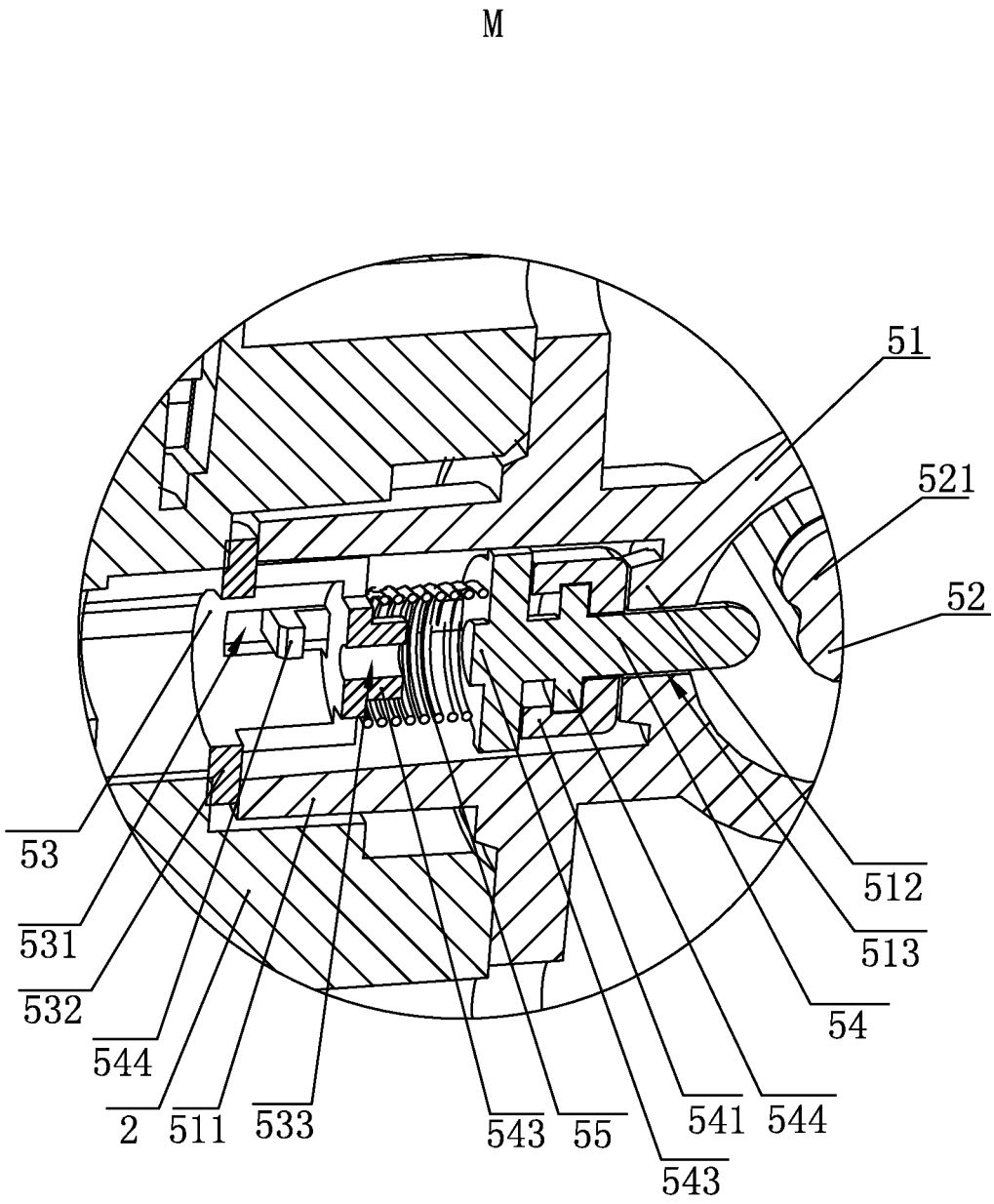
FIG. 6 is an enlarged view taken along circle M of FIG. 3.
Figure 7:
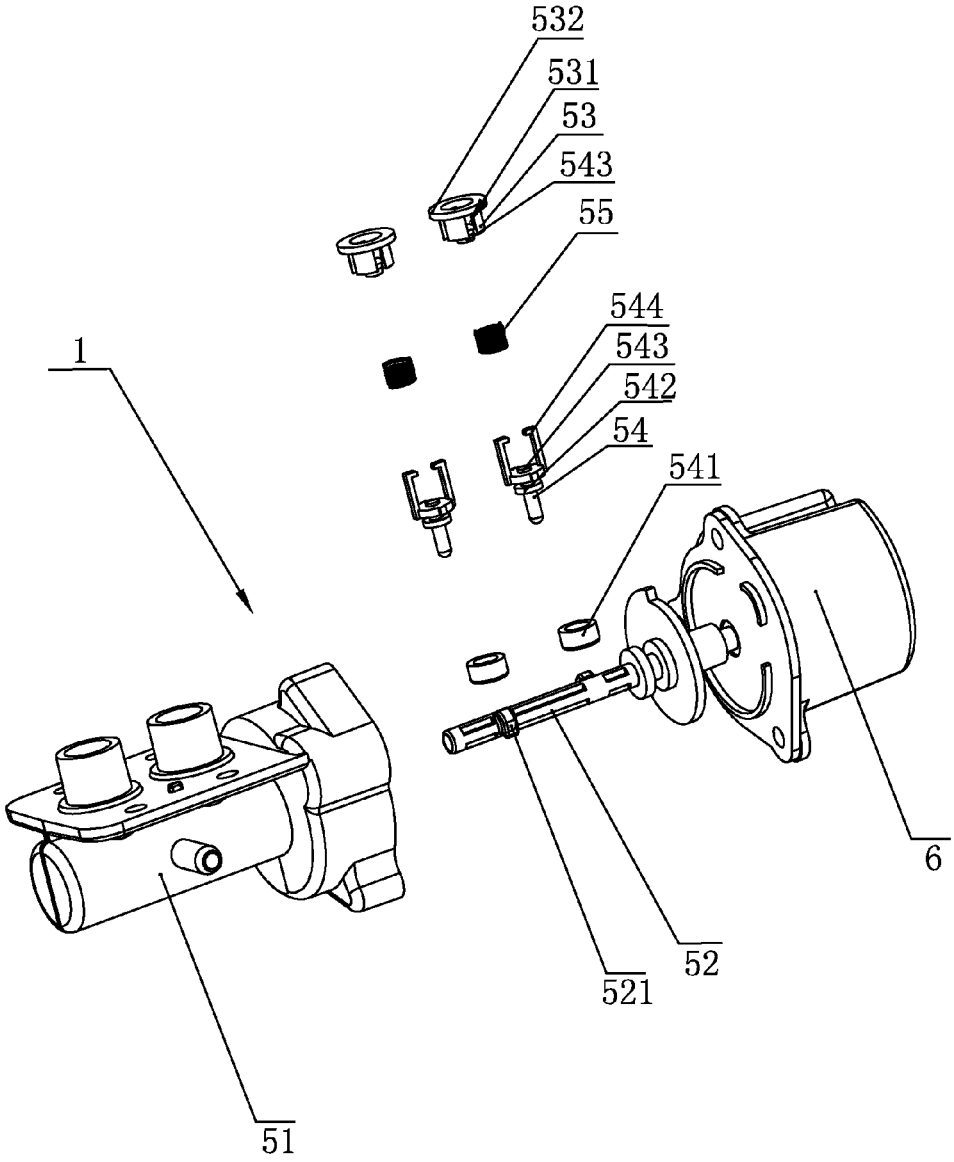
FIG. 7 is an exploded view showing the control valve and the drive motor according to the preferred embodiment of the present invention.
Figure 8:
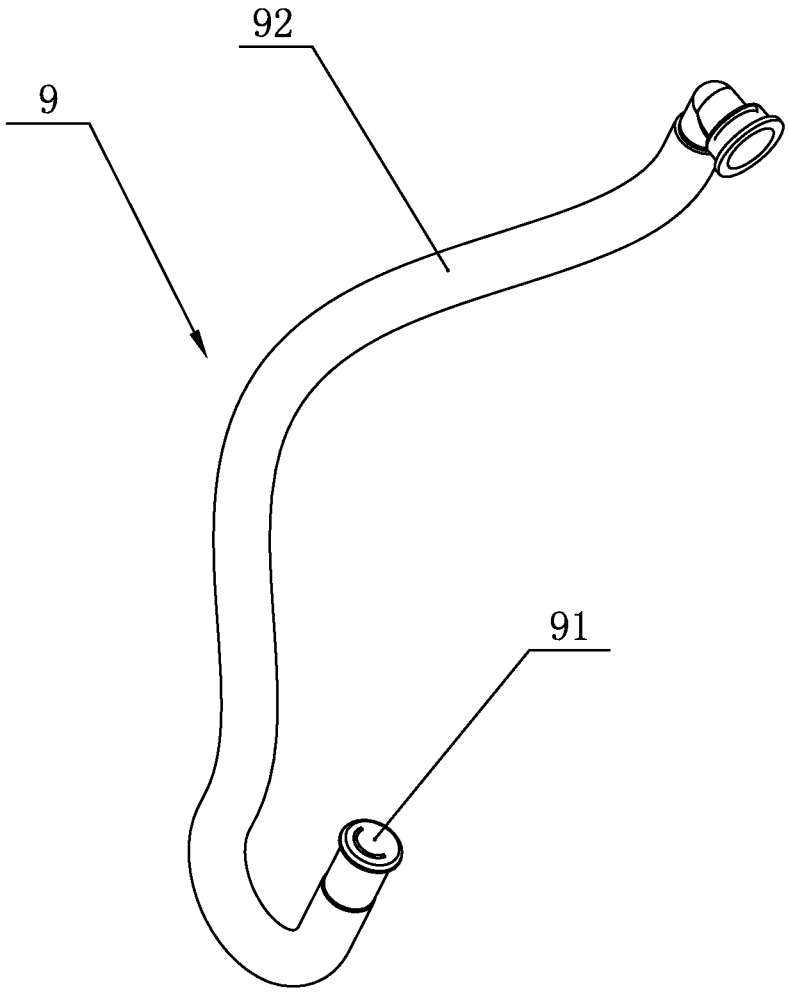
FIG. 8 is a perspective view showing the flush pipe and the spray pipe according to the preferred embodiment of the present invention.
Figure 9:
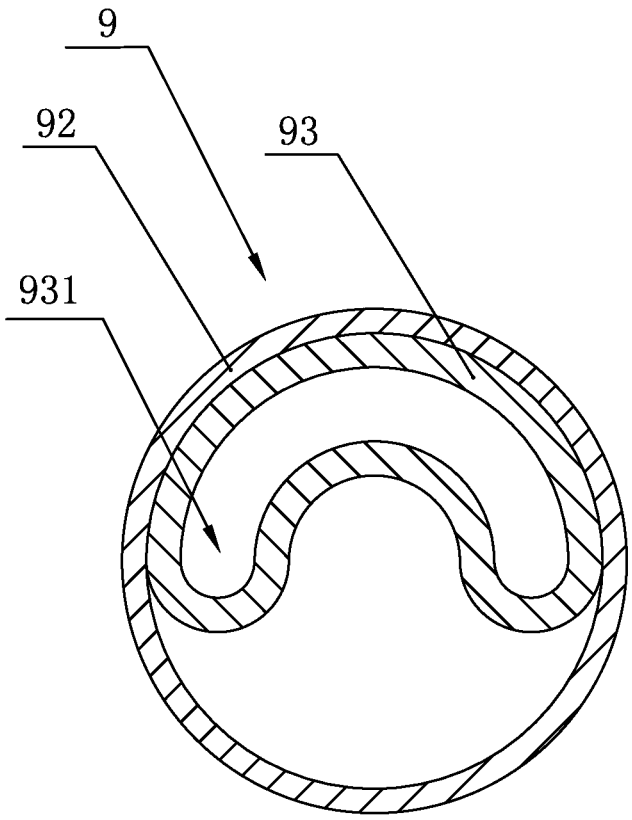
FIG. 9 is a sectional view showing the flush pipe according to the preferred embodiment of the present invention.
Figure 10:
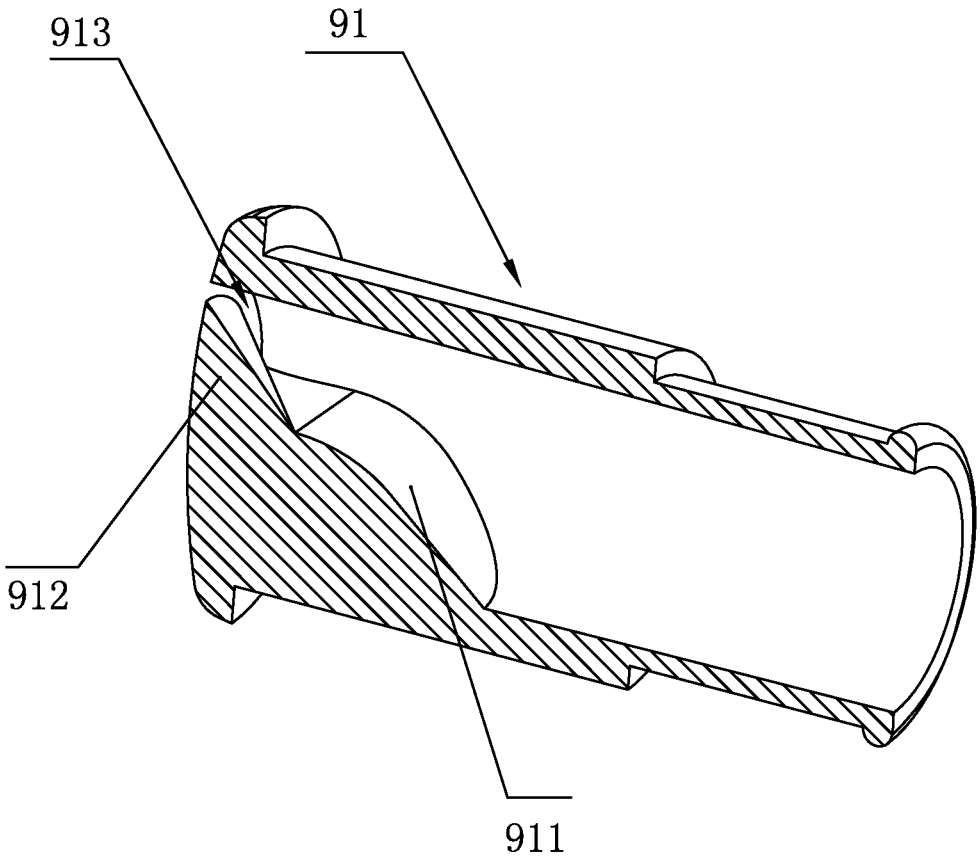
FIG. 10 is a sectional view showing the spray pipe according to the preferred embodiment of the present invention.

As shown in FIG. 1 to FIG. 10, the water-saving toilet bowl without a water tank according to a preferred embodiment of the present invention comprises a toilet bowl body 7 and a flush pipe 9 disposed in the toilet bowl body 7. The toilet bowl body 7 comprises a cavity 72 and a discharge pipe 71 communicating with the bottom of the cavity 72. The toilet bowl further comprises a flush device in the toilet bowl body 7. The flush device comprises a casing 1, an end cap 2 fixed to the casing 1, an inlet passage 11 and an outlet passage 12. The inlet passage 11 is disposed at the junction of the casing 1 and the end cap 2. The inlet passage 11 is connected with a water pipe. The outlet passage 12 is connected with a flush pipe 9. The casing 1 has a connection passage 13 therein. The inlet passage 11 and the outlet passage 12 communicate with the connection passage 13. A separation member 3 is provided between the casing 1 and the end cap 2. A control cavity 4 is defined between the end cap 2 and the separation member 3. The separation member 3 is adapted to open or close the connection passage 13 and the inlet passage 11 so as to control communication of the inlet passage 11 and the outlet passage 12. The separation member 3 has a throttle bore 31 to communicate the inlet passage 11 and the communication passage 13 with the control cavity 4. The control cavity 4 is connected to a control valve 5. The control valve 5 is controlled by a power source to open or close the control cavity 4. The power source is a drive motor 6. The drive motor 6 comprises a control switch 61 located on the toilet bowl body 7. The control valve 5 comprises an outer casing 51, a linkage rod 52 inserted in the outer casing 51 and a control valve core connected with the linkage rod 52. The linkage rod 52 is connected with a motor shaft of the drive motor 6. The end cap 2 has a hole 21 to communicate with the control cavity 4. The outer casing 51 of the control valve 5 comprises a hollow protruding post 511 corresponding to the hole 21 of the end cap 2. The control valve core is disposed in the hollow protruding post 511. One end of the hollow protruding post 511, facing the linkage rod 52, is provided with a partition 512. The partition 512 has a through hole 513. The control valve core is linked by the linkage rod 52 through the through hole 513, and the control valve core is slidably moved in the hollow protruding post 511 to open or close the through hole 513. The motor shaft of the drive motor 6 is inserted in the linkage rod 52 to drive the linkage rod 52.

In this embodiment, the flush device is located in the cavity 74 at one end of the toilet bowl body 7. The casing 1 has at least two outlet passages 12 and at least two connection passages 13. The two connection passages 13 communicate with each other. At least two separation members 3 are provided between the casing 1 and the end cap 2. Another end of the casing 1, opposite to the end cap 2, has a pressure discharge cavity 8 which communicates with the connection passages 13. A slide seal member 81 is provided between the pressure discharge cavity 8 and the connection passages 13 for connection and disconnection of the pressure discharge cavity 8 and the connection passages 13. A guide hole 82 is formed between the pressure discharge cavity 8 and the connection passages 13 of the casing 1. The slide seal member 81 is hanged in the guide hole 82 to slide axially. The pressure discharge cavity 8 communicates with the outer casing 51 of the control valve 5 through a communication pipe 83. The toilet bowl comprises two flush pipes 9 to connect with the two outlet passages 12 of the flush device. One of the two flush pipes 9 is disposed on a side wall of the toilet bowl body 7 corresponding to the opening of the cavity 72. The other of the two flush pipes 9 is disposed in the toilet bowl body 7 corresponding to the bottom of the cavity 72, and has a spray pipe 91 at one end thereof. The outer casing 51 of the control valve 5 may have an aperture to drain water.

In this embodiment, the flush pipe 9 comprises a sleeve 92 and a pipe body 93 in the sleeve 92. One end of the sleeve 92 of the flush pipe 9 corresponding to the bottom of the cavity 72 is connected with the spray pipe 91. The pipe body 93 is flexible, having one end for water feeding and another end inserted in the sleeve 92 and connected with the spray pipe 91. The junction of the flush pipe 9 and the spray pipe 91 has a concaved inner wall to form a water passage 931 having a curve cross-section. The pipe body 93 is expandable when flushing.

In this embodiment, the spray pipe 91 has an oblique block 911 on an inner wall thereof to guide water. The oblique block 911 has an outer end surface flush with the outer end surface of the spray pipe 91. The oblique block 911 has a high end to form a platform. The platform has a jet platform 912 which is inclined vertically and curved transversely. A water outlet 913 is defined between the jet platform 912 and a pipe wall. The water outlet 913 has a curve cross-section.

In this embodiment, the control valve core comprises a first valve core body 53 fixed to the end cap 2, a second valve core body 54 having an end passing the through hole 513 and linked by the linkage rod 52 and slidable in the hollow protruding post 511, and a compression spring 55 connected between the first valve core body 53 and the second valve core body 54. One end of the first valve core body 53, close to the second valve core body 54, has a communication hole 533 to communicate with the control cavity 4. The second valve core body 54 comprises a seal protrusion 543 corresponding in position to the communication hole 533 to be contact with the communication hole 533. A seal membrane 543 is provided between the second valve core body 54 and the through hole 513. The seal membrane 543 is adapted to open and close the through hole 513 along with movement of the second valve core body 54. The seal membrane 541 is disposed at one side of the through hole 513 close to the hole 21 of the end cap 2. The seal is membrane 541 is disposed at one side of the through hole 513. The seal membrane 541 may be disposed at another side of the through hole 513 according to the position of the partition 512. Alternatively, there is no need for the seal protrusion 543. The second valve core body 54 has an end surface to be contact with the communication hole 533.

In this embodiment, the first valve core body 53 has a guide slot 531 thereon and an annular positioning flange 532 at one end thereof away from the second valve core body 54. The hollow protruding post 511 presses the first valve core body 53 against the end cap 2 through the positioning flange 532. The second valve core body 54 comprises a hook 544 to mate with the guide slot 531. The hook 44 is placed in the guide slot 531 to position the second valve core body 54.

In this embodiment, the second valve core body 54 has a seal flange 542 corresponding in position to the through hole 513. The seal membrane 541 is connected to the second valve core body 54 through the seal flange 542. In other words, the seal membrane 541 is buckled on the seal flange 542 and has a central hole for insertion of the second valve core body 54. The seal membrane 541 can be fixed by other ways that can ensure the seal of the through hole 513.

In this embodiment, the linkage rod 52 comprises two press blocks 521 thereon. The end of the second valve core body 54 corresponds in shape to the press blocks 521 of the linkage rod 52. The two press blocks 521 are disposed at different positions of the linkage rod 52. The two press blocks 521 may touch the second core valve body 54 simultaneously to split water flow so that the water from each outlet passage 12 is decreased.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A water-saving toilet bowl without a water tank, comprising 1) a flush pipe, 2) a toilet bowl body, comprising 2.a) a cavity, 2.b) a discharge pipe, communicating with a bottom of the cavity, and 3) a flush device, comprising 3.a) a casing having a connection passage therein, 3.b) an end cap fixed to the casing, comprising a hole to communicate with a control cavity, 3.c) an inlet passage connected with a water pipe, disposed at the junction of the casing and the end cap, and 3.d) an outlet passage, connected with the flush pipe, with the inlet passage and the outlet passage communicating with the connection passage, and 3.e) a separation member, provided between the casing and the end cap and adapted to open or close the connection passage and the inlet passage, further comprising a throttle bore to communicate the inlet passage and the communication passage with the control cavity, 3.f) the control cavity, defined between the end cap and the separation member, 3.g) a control valve, connected to the control cavity, controlled by a power source of a drive motor to open or close the control cavity, with the drive motor comprising a control switch located on the toilet bowl body, the control valve further comprising 3.g.i) an outer casing, comprising a hollow protruding post corresponding to the hole of the end cap, 3.g.ii) a linkage rod inserted in the outer casing, and 3.g.iii) a control valve core, disposed in the hollow protruding post, connected with the linkage rod connected with a motor shaft of the drive motor, with one end of the hollow protruding post, facing the linkage rod, being provided with a partition having a through hole, wherein the control valve core is linked by the linkage rod through the through hole, and is slidably movable in the hollow protruding post to open or close the through hole.

2. The water-saving toilet bowl without a water tank as claimed in claim 1, wherein the flush device is located in the cavity at one end of the toilet bowl body, the casing having at least two outlet passages and at least two connection passages, the two connection passages communicating with each other, at least two separation members provided between the casing and the end cap, another end of the casing, opposite to the end cap, having a pressure discharge cavity which communicates with the connection passages, a slide seal member provided between the pressure discharge cavity and the connection passages for connection and disconnection of the pressure discharge cavity and the connection passages, a guide hole formed between the pressure discharge cavity and the connection passages of the casing, the slide seal member being hanged in the guide hole to slide axially, the pressure discharge cavity communicating with the outer casing of the control valve through a communication pipe, the toilet bowl comprising two flush pipes to connect with the two outlet passages of the flush device, one of the two flush pipes being disposed on a side wall of the toilet bowl body corresponding to an opening of the cavity, the other of the two flush pipes being disposed in the toilet bowl body corresponding to the bottom of the cavity and having a spray pipe at one end thereof.

3. The water-saving toilet bowl without a water tank as claimed in claim 2, wherein the flush pipe comprises a sleeve and a pipe body in the sleeve, one end of the sleeve of the flush pipe, corresponding to the bottom of the cavity, being connected with the spray pipe, the pipe body being flexible and having one end for water feeding and another end inserted in the sleeve and connected with the spray pipe, the junction of the flush pipe and the spray pipe having a concaved inner wall to form a water passage having a curve cross-section, the pipe body being expandable when flushing.

4. The water-saving toilet bowl without a water tank as claimed in claim 3, wherein the spray pipe has an oblique block on an inner wall thereof to guide water, the oblique block having an outer end surface flush with an outer end surface of the spray pipe, the oblique block having a high end to form a platform, the platform having a jet platform which is inclined vertically and curved transversely, a water outlet defined between the jet platform and a pipe wall, the water outlet having a curve cross-section.

5. The water-saving toilet bowl without a water tank as claimed in one of claims 1 to 4, wherein the control valve core comprises a first valve core body fixed to the end cap, a second valve core body having an end passing the through hole and linked by the linkage rod and slidable in the hollow protruding post, and a compression spring connected between the first valve core body and the second valve core body, one end of the first valve core body, close to the second valve core body, having a communication hole to communicate with the control cavity, the second valve core body comprising a seal protrusion corresponding in position to the communication hole to be contact with the communication hole, a seal membrane provided between the second valve core body and the through hole, the seal membrane being adapted to open and close the through hole along with movement of the second valve core body.

6. The water-saving toilet bowl without a water tank as claimed in claim 5, wherein the first valve core body has a guide slot thereon and an annular positioning flange at one end thereof away from the second valve core body, the hollow protruding post pressing the first valve core body against the end cap through the positioning flange, the second valve core body comprising a hook to mate with the guide slot, the hook being placed in the guide slot to position the second valve core body.

7. The water-saving toilet bowl without a water tank as claimed in claim 6, wherein the second valve core body has a seal flange corresponding in position to the through hole, the seal membrane being connected to the second valve core body through the seal flange.

8. The water-saving toilet bowl without a water tank as claimed in claim 7, wherein the linkage rod comprises a press block thereon, an end of the second valve core body corresponding in shape to the press block of the linkage rod.

* * * * *